United States Patent [19]

Wittman et al.

[11] 4,421,241

[45] Dec. 20, 1983

[54] REMOVABLE LIVE MAST AND HOIST UNIT

[75] Inventors: Leroy L. Wittman, Marion; Lyle B. Jensen, Cedar Rapids, both of Iowa

[73] Assignee: FMC Corporation, Chicago, Ill.

[21] Appl. No.: 257,067

[22] Filed: Apr. 24, 1981

[51] Int. Cl.[3] ..... B66C 23/26; B66C 1/12

[52] U.S. Cl. ..... 212/186; 212/182; 212/183; 212/262

[58] Field of Search ..... 212/175–187; 52/116, 117, 120, 123

[56] References Cited

U.S. PATENT DOCUMENTS

| | | | |
|---|---|---|---|
| 948,851 | 2/1910 | Forest . | |
| 3,045,837 | 7/1962 | Liebherr et al. | 212/46 |
| 3,053,398 | 9/1962 | Liebherr et al. | 212/46 |
| 3,187,906 | 6/1965 | Bushong et al. | 212/59 |
| 3,335,877 | 8/1967 | Pezzini | 212/144 |
| 3,399,785 | 9/1968 | Mork | 212/39 |
| 3,664,516 | 5/1972 | Goudy | 212/46 A |
| 3,792,781 | 2/1974 | Blase et al. | 212/59 |
| 3,794,184 | 2/1974 | Higgins | 212/46 A |
| 3,977,530 | 8/1976 | Helm et al. | 212/46 R |
| 3,977,531 | 8/1976 | Brewer | 212/59 R |
| 4,081,081 | 3/1978 | Morrow, Sr. | 212/186 |

*Primary Examiner*—Trygve M. Blix
*Assistant Examiner*—C. T. Bartz
*Attorney, Agent, or Firm*—A. J. Moore; R. B. Megley

[57] ABSTRACT

A removable live mast and hoist unit is disclosed for use with a crane of the type having a pivotal live mast releasably connected to the boom of a crane for raising and lowering the boom. The unit includes the live mast and a boom hoist frame that are rigidly secured together with the boom hoist, reeving, mast bridle and bail all partially enclosed within portions of the mast and a cavity in the frame to protect the reeving and to permit easy removal of the unit without unwinding the reeving.

4 Claims, 4 Drawing Figures

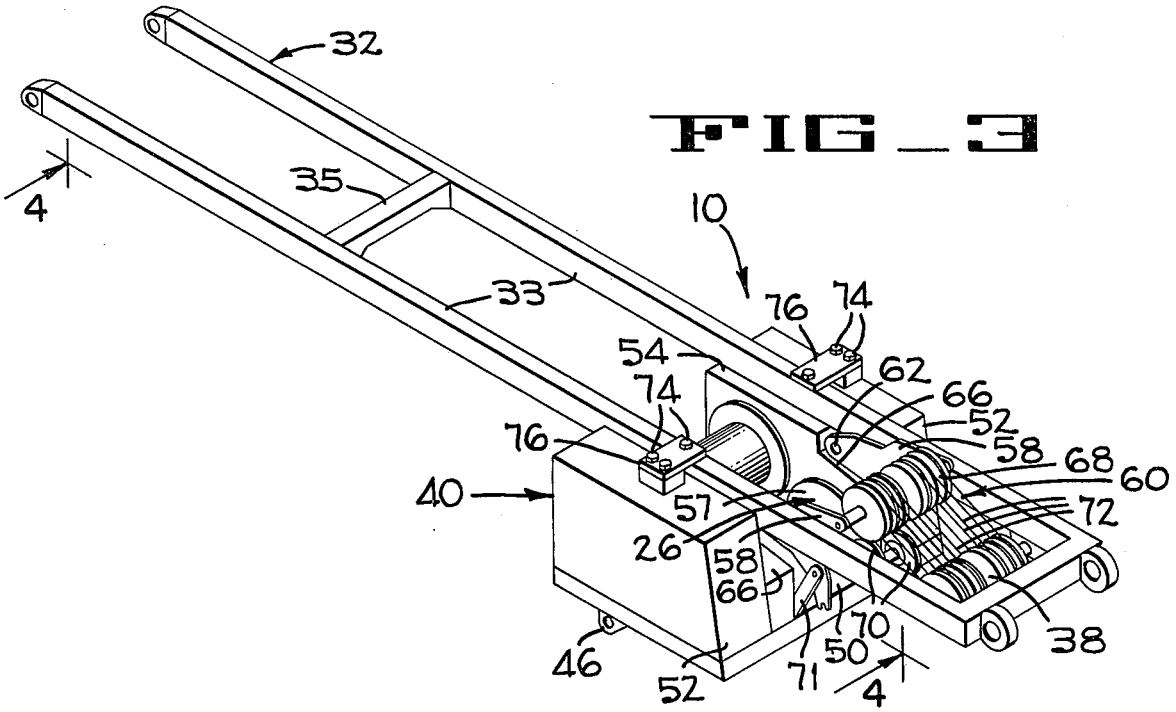
FIG_3
FIG_4
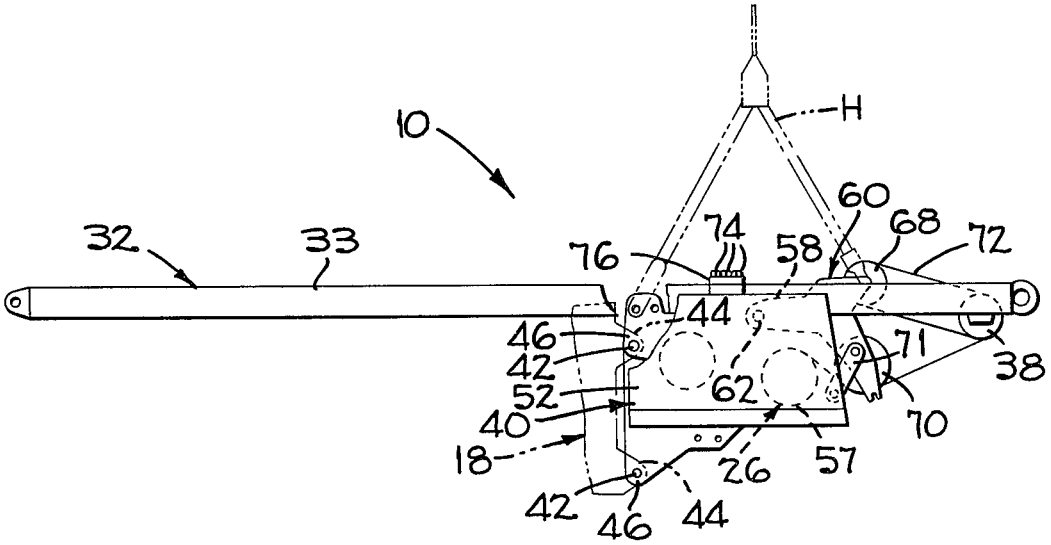

REMOVABLE LIVE MAST AND HOIST UNIT

BACKGROUND OF THE INVENTION

1. Field of the Invention

The present invention relates to crane assembly and disassembly procedures and more particularly relates to an apparatus for rigidly securing a live mast, boom hoist frame, and drums with reeving together as a unit for quick attachment and removal from a crane.

2. Description of the Prior Art

It is well known that large cranes or the like must be disassembled and reassembled so as to be moved by trucks or trains between different work sites spaced considerable distances apart. One type of crane uses a live mast with a boom hoist connected to the mast by multiple strand reeving for pivotally raising or lowering the boom through fixed pendant lines. Heretofore, one problem for assembling or disassembling this type of crane was that the reeving had to be wound on and off of the associated drum for each long move of the crane, which winding process is both time consuming and requires considerable effort.

In another type of crane the boom is pivotally raised and lowered by a winch on the upper works and reeving connected thereto and between sheaves on a gantry frame and sheaves on a bridle frame. Pendants connect the bridle frame to the boom. When the crane is in operation, the gantry is in rigid fixed position; however, the gantry may be collapsed so that the gantry, boom hoist, and reeving may be removed as a unit. U.S. Helm et al Pat. No. 3,977,530 discloses such a structure.

SUMMARY OF THE INVENTION

In accordance with the present invention a boom hoist frame, carrying a power driven boom hoist and a pivotal bail assembly is removably mounted on the upper works of a crane. Bridle sheaves on a live mast are connected to the bail and winch by the reeving. During normal crane operation the live mast is connected to a boom by pendant lines and is pivoted in a vertical plane for raising and lowering the boom in response to rotation of the winch drum. When the crane is to be disassembled, the live mast is disconnected from the boom and is lowered to a horizontal position with portions of the live mast in nested position within the boom hoist frame. Portions of the bail, and hoist are partially encompassed with the live mast and frame to protect these components during shipping. The live mast is rigidly secured in nested position to the frame, and the live mast and frame are disconnected and removed from the upper works as a unit with the reeving connected and with the mounting holes in the live mast and frame locked in fixed position relative to each other for easy reassembling.

BRIEF DESCRIPTION OF THE DRAWINGS

FIG. 3 is a perspective of the live mast and boom hoist frame and supported components secured together as a unit in transport position.

FIG. 4 is a side elevation taken in the direction of arrows 4—4 of FIG. 3 illustrating the manner in which the live mast is rigidly connected in nested relation to the boom hoist frame, and the manner in which the frame and mast surround and protect the reeving during shipment, said view also illustrating the structure for removing the live mast and hoist unit from the crane.

DESCRIPTION OF THE PREFERRED EMBODIMENT

Figure 1:
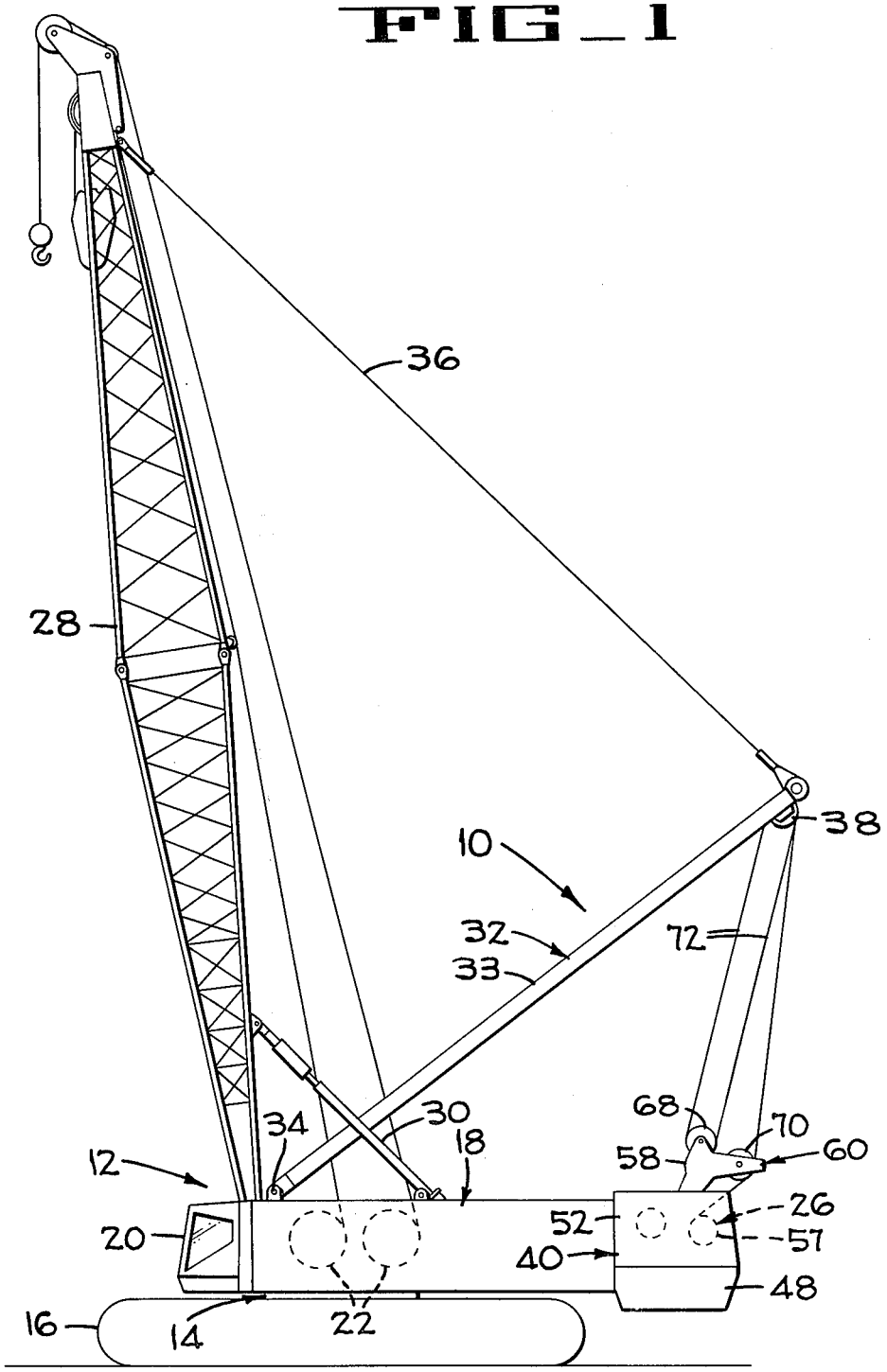
FIG. 1 is a diagrammatic side elevation of a crane embodying the removable live mast and hoist unit of the present invention.
Figure 2:
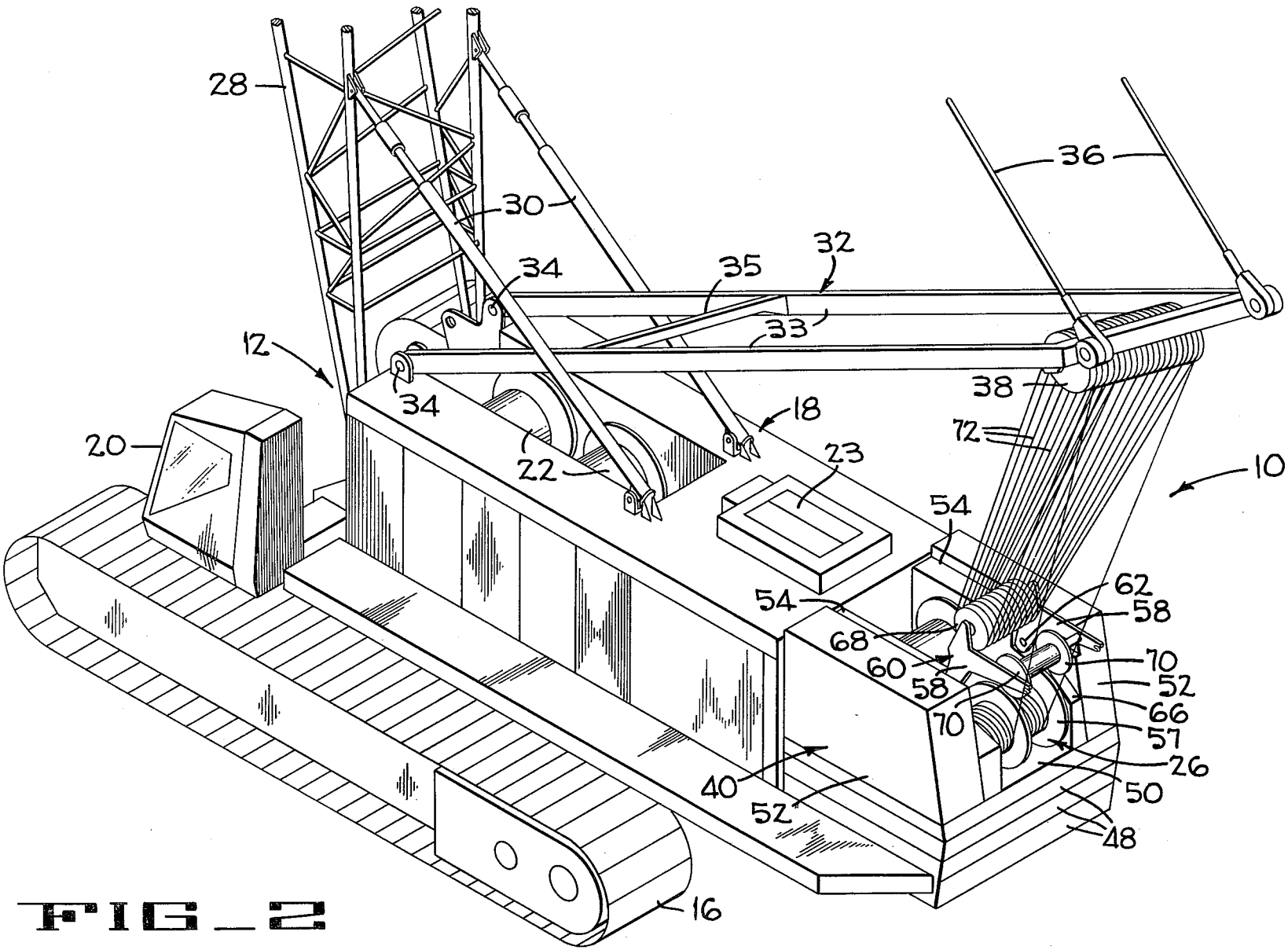
FIG. 2 is a perspective of a portion of the crane of FIG. 1.

The removable live mast and hoist unit 10 (FIGS. 3 and 4) of the present invention is shown in operative position on a crane 12 in FIGS. 1 and 2.

The crane 12 comprises a lower works 14 supported on track assemblies 16. An upper works 18 is supported for rotation about a vertical axis on the lower works 14 and includes an operator's cab 20 at its front end, one or more load winches 22, and power means including an engine 23 for driving the track assemblies, the load winches 22 and a boom hoist winch 26. A boom 28 is pivotally supported near the front end of the upper works 18 and is prevented from excessive rearward pivotal movement by telescopic boom stops 30 that are pivotally connected between the boom 28 and the upper works 18. The forward end of a live mast 32 is generally U-shaped and includes two legs 33 with their forward ends pivotally connected to forward ends of the upper works 18 by removable pivot pins 34. Transverse members 35 are rigidly secured to the legs 33 to stiffen the live mast. The rear end of the live mast 32 is connected to the upper end of the boom 28 by fixed length pendants 36, and a multi-sheave bridle frame 38 is journaled on the rear end of the mast 32.

A boom hoist and counterweight frame 40 is connected to the rear end of the upper works 18 by four removable pins 42 (only two shown in FIG. 4) which are received within cooperating ears 44 and 46 rigidly secured to the upper works 18 and to the frame 40, respectively. The frame 40 releasably supports three counterweights 48 secured therebelow during operation of the crane, but released therefrom when the live mast 32 and frame 40 of the hoist unit 10 are to be removed as a unit from the crane.

The boom hoist frame 40 is of generally U-shaped construction and includes a base 50 (FIGS. 2 and 3) and upstanding walls 52 having means defining angle cutouts 54 for receiving portions of the live mast legs 33 in nesting engagement when in their transport position as shown in FIGS. 3 and 4. The boom hoist 26 with its two section drum 57 is housed within the U-shaped frame 40. Also, arms 58 of a bail assembly 60 are pivoted by pins 62 to the inner walls 52 of the frame 40, which walls are also grooved at 66 to permit the arms 58 to pivot from their operative upright positions (FIGS. 1 and 2) to their stowed positions (FIGS. 3 and 4). A bail 68 is journaled on the arms 58, and a pair of guide sheaves 70 are rotatably and transversely slidably received on a shaft secured to the arms 58 to guide the end strands of the reeving when being wound on or off the drum 57 of the boom hoist winch 26. When the bail assembly 60 and components thereon are in their stowed position, they are partially nested within and protected by the U-shaped hoist frame 40 and the adjacent members of the live mast 32. Also, when stowed, the arms 58 are connected to the frame 40 by tubular struts 71 bolted to the bail arms 58 and to the frame 40 for preventing pivotal movement of the bail assembly when being lifted from the crane by an auxiliary crane (not shown) and harness H connected to the frame 40 and bail arms 58 as shown in dotted lines in FIG. 4.

The two section drum 57 of boom hoist 26 receives the end portions of the reeving 72, which reeving is trained around the live mast bridle 38, the bail 68, and the guide sheaves 70 before being wound on the associated sections of the hoist drum 57. Thus, when the boom hoist 26 is selectively operated to rotate the drum 57 in one direction, the live mast 32 will pivot clockwise (FIG. 1) thereby raising the boom 28; and when rotated in the opposite direction the live mast 32 will pivot counterclockwise thereby lowering the boom.

In the disassembly operation, the boom 28 is first pivotally lowered from an active position such as illustrated in FIG. 1 until the booms outer ends rest on the ground. During this movement the boom hoist 26 controls counterclockwise movement of the live mast 32. The pendant lines 36 are then disconnected from the outer end of the live mast 32, and the live mast is connected to the load line of an auxiliary crane (not shown) to resist free clockwise gravitational movement of the mast 32 and to maintain tension on the reeving 72 as the boom hoist 26 reeves in the line. As the live mast 32 approaches the stored or transport position shown in FIGS. 3 and 4, the bail assembly 60 pivots from an exposed position as shown in FIG. 1 to its stowed position as shown in FIGS. 3 and 4. The straps 71 are then bolted in position so that the reeving 72, hoist 26, bail 68 and live mast bridle 38 are substantially confined within walls defined by the U-shaped boom hoist frame 40 and the outer end portions of the live mast. Thus, the reeving is wound and held under tension on its several supporting members when in stowed position thereby eliminating the need for unwinding and rewinding the reeving when the live mast is again to be placed in an operative position. The live mast 32 is then firmly locked to the boom hoist frame while nested in the cut-outs 54 by means such as bolts 74 and straps 76 which are provided to rigidly secure the live mast 32 to the frame 40 prior to releasing the pins 34 and 42.

When the live mast 32 has been lowered into its lowermost position with the mast legs 33 nested in the cutouts 54 of the frame 40, the forward portion of the legs 33 are connected to the upper works by the removable pins 34. The lock means 74,76 retain the pin positions for fast and easy reassembly. Thus, when the live mast has been fully lowered and secured to the frame 40, the two live mast pivot pins 34 and the four hoist frame pins 42 are accurately positioned relative to each other.

After the live mast 32 and boom hoist frame 40 have been locked together as a unit and after the counterweights 48 have been removed, the unit 10 is connected to an auxiliary crane (not shown). The mast connecting pins 34 and the frame connecting pins 42 are then removed and the auxiliary crane (not shown) is actuated to lift the harness H and the removable live mast and hoist unit 10 free of the crane 12 for storage or trucking to a new location.

When it is desired to reassemble the unit 10 on the upper works 18, the auxiliary crane (not shown) is used to place the lower end of the live mast 32 and the ears 46 on the frame 40 in position to receive the associated locking pins 34 and 42 on the upper works 18. The pins 34 and 42 are then inserted, winch control and power means are reconnected, and the mast 32 is unlocked from the frame 40. The auxiliary crane is then attached to the outer end of the live mast 32 to pivot the outer end of the live mast 32 counterclockwise while the winch is driven but retains tension on the reeving 72. The pendant lines 36 are then reconnected to the live mast 32 thus completing the reassembly operation.

From the foregoing description it is apparent that the removable live mast and hoist unit of the present invention locks a portion of the live mast in nesting position with the boom hoist frame when in stowed position for substantially confining the winch, bail and winch drum with the reeving attached within protective walls of the live mast and winch frame. Also, accurate locking of the nested live mast to the frame provides for easy reconnection of the unit to the frame.

Although the best mode contemplated for carrying out the present invention has been herein shown and described, it will be apparent that modification and variation may be made without departing from what is regarded to be the subject matter of the invention.

What is claimed is:

1. A removable live mast and boom hoist unit for a crane of the type wherein pivotal movement of the mast causes similar pivotal movement of the crane boom, comprising: a generally U-shaped live mast having a closed end and an open end releasably connected to the crane and to the boom; a bridle journaled on the mast; a boom hoist and counterweight frame releasably connected to the crane and having a cavity therein; a power drive boom winch secured to the frame in the cavity and including a rotatable drum; a bail assembly pivoted to said frame for pivotal movement about a transverse axis and having a bail journaled for rotation thereon and adapted to swing about said axis along an arc of constant radius; reeving trained around said drum, bail, and bridle and disposed between said mast and frame when in an operative boom supporting position; said winch being effective to maintain tension on said bail and pivot a portion of said mast into engagement with said frame with said closed end extending beyond said frame when said mast and boom are disconnected; and means for rigidly securing said mast to said frame with said winch, bail assembly, drum and reeving encircled by said frame and said closed end of said mast; said mast and frame along with the components supported thereon being removable as a unitary structure from the crane when released therefrom.

2. An apparatus according to claim 1 and additionally comprising means for securing said bail to said frame to prevent pivotal movement thereof when in the stowed position and when removed from the crane as a unitary structure.

3. In a crane of the type having an upper works pivotally supporting a boom and live mast with said mast including an outer end rotatably supporting a bridle and sheaves and a cross member connected to the boom by pendants, the improvement comprising a removable mast and hoist unit releasable from said boom and removable from the crane as a unitary structure; said unit comprising a boom hoist and counterweight frame of generally U-shaped construction, removable connecting means for connecting said mast and frame to said upper works when said crane is in normal operating position, a power driven boom hoist winch confined within said frame when in normal operating position and when removed from the crane, a bail assembly with a rotatable bail thereon pivotally connected to said frame for arcuate movement about a transverse axis between an active boom supporting position extending upwardly out of said frame and a stowed position substantially confined within said frame, reeving connected to said winch and trained around said bail and said bridle and disposed between said mast and frame when in an operative boom supporting position, said winch being effective to draw said mast into firm engagement with said frame with said cross member extending beyond said frame and causing said bail to pivot into near horizontal alignment with said sheaves whereby said mast and cross member encircle said bridle and bail assembly, and means for rigidly securing said mast to said frame in stowed position whereupon removal of said connecting means permits said mast, frame and hoist to be removed from the crane as a unitary structure with the reeving attached and protected.

4. An apparatus according to claim 3 and additionally comprising means for securing said bail assembly to said frame to prevent pivotal movement thereof when in the stowed position and when removed from the crane as a unitary structure.

* * * * *